United States Patent [19]

Lau

[11] Patent Number: 4,597,139

[45] Date of Patent: Jul. 1, 1986

[54] LARGE CAPACITY PAPER CLIP

[76] Inventor: Po C. Lau, 9224 Wilkinson Ave., North Hollywood, Calif. 91605

[21] Appl. No.: 574,550

[22] Filed: Jan. 27, 1984

[51] Int. Cl.[4] ..... B42F 1/02

[52] U.S. Cl. ..... 24/546; 24/67.9; 24/547; 24/549; 24/552

[58] Field of Search ..... 24/67 CF, 67 P, 67.3, 24/67.9, 546, 547, 550, DIG. 8, DIG. 10, 67 R, 548, 549, 551, 552, 555, 556

[56] References Cited

U.S. PATENT DOCUMENTS

| | | | |
|---|---|---|---|
| 31,430 | 8/1899 | Powers | 24/67 R |
| 848,762 | 4/1907 | Mueller | 24/552 |
| 879,007 | 2/1908 | Root | 24/546 |
| 1,152,406 | 9/1915 | Gifford | 24/552 |
| 1,207,486 | 12/1916 | Bradley | 24/549 |
| 2,040,443 | 5/1936 | Pashoian | 24/547 |
| 2,153,724 | 4/1939 | Randall | 24/547 |
| 2,822,593 | 2/1958 | Sponsel | 24/67.9 |
| 2,947,047 | 8/1960 | Guzell | 24/67.9 |
| 4,523,354 | 6/1985 | Tsukamoto | 24/67.9 |

FOREIGN PATENT DOCUMENTS

| | | | |
|---|---|---|---|
| 365361 | 12/1922 | Fed. Rep. of Germany | 24/67.3 |

*Primary Examiner*—William E. Lyddane
*Assistant Examiner*—Laurie K. Cranmer
*Attorney, Agent, or Firm*—Poms, Smith, Lande & Rose

[57] ABSTRACT

The paper clips of the present invention are more gradually curved to have a substantial lateral extent, so that they will hold a much thicker stack of papers without deformation or buckling, as compared with the standard narrow sharply curved paper clips. More specifically, when a predetermined length of wire is employed, the clips have a ratio of the predetermined length to the width, and to the height of the clip, of between about 4 and 6. In addition, where one end of the wire is arranged to engage a stack of papers on one side and the other end of the wire is arranged to engage the stack of papers on the other side, at a point between the two ends there is a gradually curved portion corresponding generally to one-half the circumference of a circle having a diameter in the order of the transverse dimension of the clip. In one embodiment the clip has an overall generally heart-shaped configuration; and in another embodiment one end of the clip is straight and the other is formed into a relatively tight loop.

4 Claims, 8 Drawing Figures

LARGE CAPACITY PAPER CLIP

FIELD OF THE INVENTION

The present invention relates to paper clips.

BACKGROUND OF THE INVENTION

Many different types of paper clips have been proposed heretofore, and the most common form of paper clips come in two sizes, with the larger size being formed from a piece of wire which is approximately 6½ or 6⅝ inches in length. These clips are normally about 2 inches or slightly less in length and about ⅜ inch in width. Now, particularly when several separate stacks of clipped papers are to be piled up on one another, it is most desirable that the paper clips lie flat upon the top and bottom sheets of the smaller stacks of papers being held together by each clip. Using conventional large size paper clips of the type mentioned above, when the thickness of a stack of papers reaches approximately 1/16th of an inch in thickness, the paper clip tends to bow out from the paper. More specifically, this bowing starts when the stack of paper gets to be about 1/16th of an inch thick and by the time the thickness of the papers to be secured together reaches 5/16th of an inch, the clip bows out approximately ¼ inch on one side and about 3/16ths on the other side. Accordingly, it is quite inconvenient to try to stack up several stacks of papers which are clipped together with these large clips, where the extent of the clip above and below the papers to be held together is about 7/16ths of an inch as compared with the thickness of the stack of only 5/16ths of an inch. In addition, the ends of the wires of conventional paper clips frequently bite into the paper and score or tear it as the clips are being removed from the paper.

Accordingly, a primary object of the present invention is to provide an economical paper clip which is capable of holding together thick stacks of paper, with the paper clip still being in close engagement with the top and bottom of the sheets of paper and not bowing out from the stacks. A subordinate object of the present invention is to provide a paper clip which will hold the papers securely but will not score or damage the paper as the clips are being removed.

SUMMARY OF THE INVENTION

A paper clip for holding relatively thick stacks of paper without bowing away from the paper, formed of a predetermined length of wire, includes a first portion near one end of the length of the wire for engaging one side of the stack of papers and another portion near the other end for engaging the other side of the stack of papers, and an additional portion of wire in a form substantially corresponding to one-half the circumference of a circle having a diameter generally corresponding to the maximum height or width dimension of the paper clip. In addition, the clip has an overall width to height ratio in the order of between 0.7 and 1.5 and having a ratio of the predetermined length of wire to the width and to the height of said clip between about 4 and 6.

Particular forms of the paper clip include one embodiment which is substantially heart-shaped, and another embodiment which has one end forming a substantial diameter for the circumferential portion of the clip and the other being a tight loop at the opposite end of the length of wire.

Advantages of the clip include the fact that even with relatively thick stacks of paper, in the order of 5/16ths of an inch or more thick, and using a clip made of the same length as a standard large paper clip, i.e., approximately 6⅝ths inches, the clips made in accordance with the invention lie flat against the stack of papers on both sides thereof. In addition, the clips of the present invention are more aesthetically pleasing, and may be conveniently used both to extend through the holes of punched sheets of paper and for purposes such as holding keys and securing them to belt loops or other desired locations on the clothing or secured to the purse or other article of personal property.

Other objects, features and advantages will become apparent from a consideration of the following detailed description and from the accompanying drawings.

BRIEF DESCRIPTION OF THE DRAWINGS

FIGS. 7 and 8 show the paper clips of FIGS. 1 and 2 employed to retain keys to belt loops or the like.

DETAILED DESCRIPTION OF PREFERRED EMBODIMENTS

Figure 1:
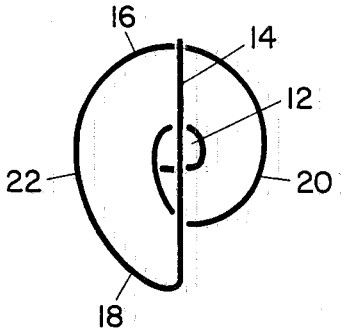
FIG. 1 shows a configuration of a paper clip illustrating the principles of the invention.

Referring more particularly to the drawings, FIG. 1 shows a paper clip illustrating the principles of the present invention. As will be discussed below, the paper clips of FIGS. 1 and 2 were made with sections of wire having the same length as conventional paper clips, for comparison purposes. In FIG. 1, one end 12 of the clip is formed into a relatively tight loop, and the other end 14 is a straight section which extends back across the loop 12 and just beyond the portion 16 at the top of the clip as shown in FIG. 1. It may also be noted that the clip of FIG. 1 has a portion between point 18 and point 16 which corresponds generally to the circumference of a semi-circle having a diameter corresponding to one of the maximum dimensions of the clip. In addition, it may be noted that the width of the clip from point 20 to point 22 is generally comparable to the height of the clip. More specifically, using a 6⅝ inch piece of wire, the height of the clip is approximately 1 9/16 inch while the width of the clip is about 1¼ inch. This is a ratio of about 1.3.

Figure 2:
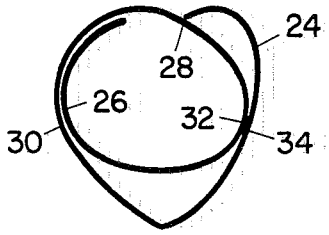
FIG. 2 shows an alternative embodiment of the invention in which the overall configuration of the paper clip is substantially heart-shaped.

The clip of FIG. 2 is substantially heart-shaped, and includes one end 24 and the other end 26 which will engage the top and bottom of a sheaf of papers. It may also be noted that the ends of the paper come very close to and are substantially contiguous with adjacent portions of the wire 28 and 30 which will be on the opposite sides of the paper. Similarly, the points 32 and 34 are contiguous to one another when the clip is not in use but will be opposite one another on opposite sides of the sheaf of papers when the clip is in use. As in the case of the clip of FIG. 1, the width of the heart-shaped clip of FIG. 2 is generally comparable to the height thereof, and in this case the ratio is approximately 1 to 1. It may also be noted that in the section of the clip extending from point 32 through point 28 to point 30 there is a section corresponding generally to one-half of the circumference of a circle having a diameter corresponding to the height or width dimension of the clip.

In order to obtain a clip which will hold the maximum amount of sheets of paper without buckling, for a given length of wire which is included in the clip, it is desirable that the clip not have unnecessary twists and turns which waste the length of wire which is available. Accordingly, in addition to the height and width of the clip preferably being of the same order of magnitude, it is also desirable that the ratio of the total length of wire to the height and to the width of the clip be in the order of between 3.5 and 6.0. In the case of the clip of FIG. 1, with a length of wire of $6\frac{5}{8}$ inches, a width of $1\frac{1}{4}$ inches, and a height of 1 9/16th inches, the ratios are 4.24 and 5.3. With the heartshaped clip of FIG. 2, having a height and width both approximately equal to $1\frac{3}{8}$ inches, the ratio is approximately 4.8. Accordingly, it is considered desirable that the ratio should be between about 3.5 and 6.0.

Figure 3:
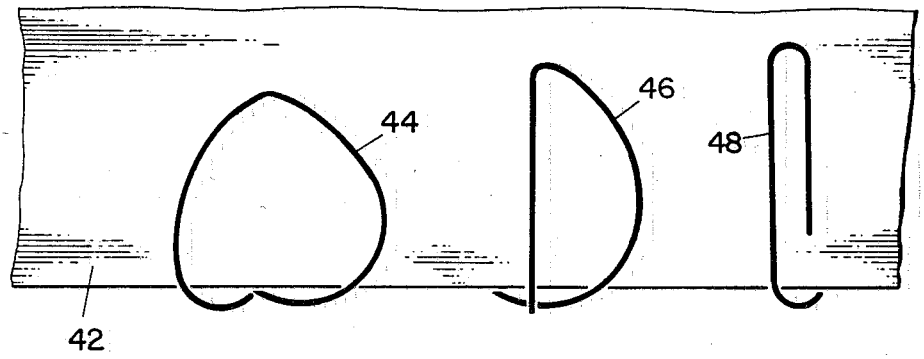
FIGS. 3 and 4 show the paper clips of the invention together with a paper clip having the same length of wire but formed in a conventional paper clip configuration secured to a relatively thick stack of papers, for comparison purposes.
Figure 4:
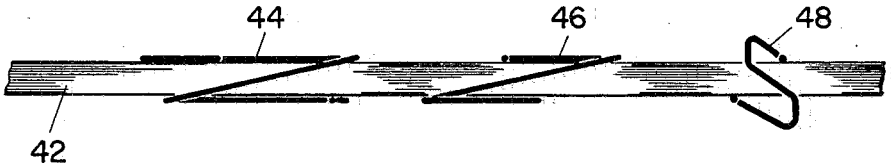

Turning now to FIGS. 3 and 4, mounted on the thick stack of papers 42 is the heart-shaped clip 44 of FIG. 2, the clip 46 of FIG. 1 and a conventional large size paper clip 48. As indicated in FIG. 4, even with a relatively thin stack of papers 42 which is less than $\frac{1}{4}$ of an inch thick, the conventional paper clip 48 is bowed out of shape and extends upward and downward from the stack of papers by a distance of at least 3/16ths inch. Accordingly, if several stacks of papers each provided with a conventional clip such as that shown at 48 are stacked up, the interference between the clips would be substantial so that the papers could not lie flat.

On the other hand, as shown in FIG. 4, with the clips of the type shown in FIGS. 1 and 2 illustrating the principles of the present invention, the clips 44 and 46 lie flat at both the upper and lower surfaces of the stack of papers 42 and do not protrude away from the surface in a manner of the conventional clip 48.

Figure 5:
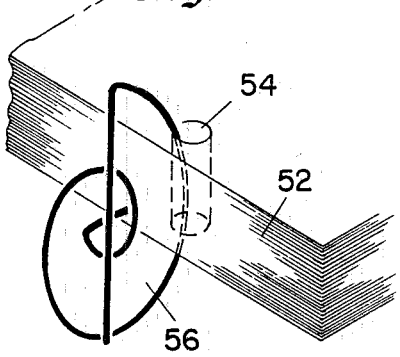
FIGS. 5 and 6 show the paper clips of FIGS. 1 and 2 employed to extend through the punched holes in a stack of papers.
Figure 7:
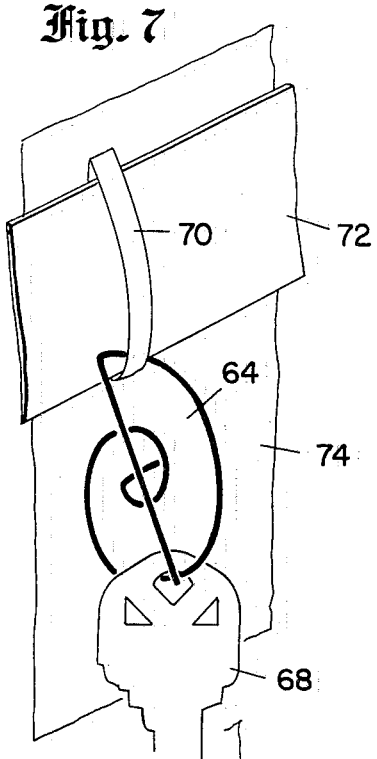
Figure 6:
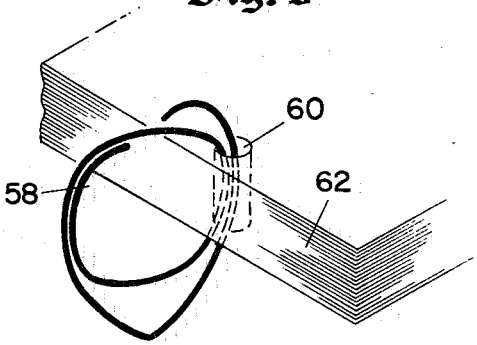
Figure 8:
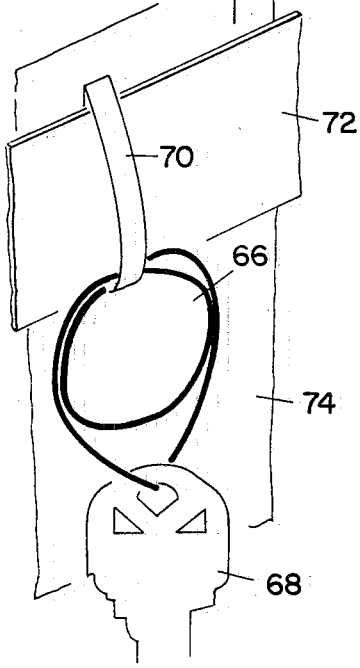

The remaining figures of the drawing on the second sheet of the drawings show alternate uses for the clips of FIGS. 1 and 2. More specifically, in FIG. 5, a stack of papers 52 is provided with a punched hole 54 through which the clip 56 extends. Similarly, in FIG. 6, the heart-shaped clip 58 extends through the hole 60 in the stack of papers 62. FIGS. 7 and 8 show the clips 64 and 66, conforming to the clips of FIGS. 1 and 2, respectively, employed to hold a key 68 to a belt loop 70. The belt 72 and pair of pants 74 also appear in both FIGS. 7 and 8.

The special heart-shaped form of the clip of FIG. 2 may have a special interest for use with red coated paper clip wire, for Valentine's Day or other special occasions. Thus, in addition to the unquestioned superiority in being able to grip larger and thicker stacks of paper without deformation, the clips illustrating the principles of the present invention have a more pleasing aesthetic appearance and are accordingly more likely to be preferred by discriminating users of office supplies. In addition, as mentioned previously, the clips of the present invention are arranged so that they will not score or damage the paper as they are being removed, unlike conventional clips where the ends will often dig into the outside sheets of paper.

For completeness, the prior patents to W. A. Guzell U.S. Pat. No. 2,947,047 and to C. Sponsel U.S. Pat. No. 2,822,593 may be noted. Concerning the Sponsel patent, it has some intricate shapes, but does not include the features of applicant's arrangements as discussed hereinabove or as set forth in the claims. In addition, it would appear that the edges of the Sponsell clips would tend to score the paper as the clips are being removed and further, that the clips would tend to bend or deform sheets of paper when only a few of them are being clipped together. With regard to the Guzell patent, the arrangement of FIG. 6 has certain aspects which are similar to those of applicant. However, there is no area where the portions of the clip which are intended to be on opposite sides of the paper, are contiguous. Accordingly, the clip will tend to bow out and deform sheets of paper when only two or three sheets are being clipped together, for example. In addition, with the loop 12 being present, the clips have a much smaller holding capacity for a given length of wire which is being used. In addition, if the bent-up end 6 is in engagement with sheets of paper, severe scoring may occur as the clips are being removed. Further, the geometry of these prior clips is such that they will tend to become entangled with oneanother. Of course, none of these problems are encountered when clips of the present invention are employed.

In summary, as compared with conventional paper clips, the clips of the present invention are capable of holding much thicker stacks of paper without significant deformation. As mentioned above, conventional large size paper clips deform significantly as shown at 48 in FIG. 4 even with only a stack of papers one quarter of an inch thick. With thicker stacks of paper, such as 5/16 inch, the conventional clips will not be operative and if they are permanently deformed onto the papers, they severely score them, and tend to slip off. On the other hand, the clips in accordance with the present invention will hold stacks of paper $\frac{3}{4}$ inch thick and even slightly thicker, without significant deformation.

Viewed from another aspect, using a length of wire approximately four inches long, the length used in small size conventional clips, the new design will hold a stack of paper between $\frac{3}{8}$ and $\frac{1}{2}$ inch thick, substantially more than the capability of jumbo conventional clips which include a length of heavier wire $6\frac{7}{8}$ inch long. Accordingly, significant economies in cost may be achieved through the use of the new designs.

It is also noted that the tangling of conventional paper clips is avoided or significantly reduced by the new designs.

It is to be understood that the foregoing detailed description and the accompanying drawings are illustrative of preferred embodiments of the invention. However, various changes may be included in the clip structure without departing from the spirit and scope thereof. Thus, other wire configurations having comparable ratios and substantially corresponding height and width parameters as outlined hereinabove, could be employed. In addition, the clips may of course be made of any desired size including an extra large size clip mounted on a base for receiving and storing bills, invoices or the like. Accordingly, the present invention is not limited to that precisely as shown and described hereinabove.

What is claimed is:

1. A paper clip formed of a predetermined length of wire, said clip having a predetermined height as measured perpendicular to the edge of the paper being held, with the clip extending the greatest distance over the paper, and a predetermined width measured parallel to said edge of the paper, comprising:

one end portion of said wire forming the diameter of a substantial semi-circle, with the adjacent portion of said wire substantially forming the circumference of said semicircle;

the remaining portion of said wire forming a tight loop near the center of said one end portion;

said clip including means for preventing scratching of the paper by ends of the clip directed toward or away from the edge of the paper as the clip is being put directly onto the paper or is being removed directly from the paper;

said clip further including at least four spaced points of immediate opposition between the portion of the clip for engaging the paper on one side, and the opposing portion of the clip for engaging the other side of the paper; and the ends of the wire forming said clip being in immediate proximity to another portion of the wire of said clip, to avoid tangling of said clip with other clips.

2. A paper clip as defined in claim 1 wherein said clip has an overall width-to-height ratio of between 0.7 and 1.5.

3. A paper clip as defined in claim 1 wherein said clip has a ratio of the said predetermined length of wire to the width and to the height of said clip of between about 3.5 and 6.0.

4. A paper clip as defined in claim 1 wherein said clip, including said curved portion substantially in the form of one-half of the circumference of a circle, has a diameter in the order of one-quarter to one-sixth of said predetermined length of wire.

* * * * *